United States Patent [19]

Fisco, Jr.

[11] 4,199,837

[45] Apr. 29, 1980

[54] APPARATUS FOR SEWER CLEANING AND THE LIKE

[75] Inventor: Benjamin P. Fisco, Jr., Shaker Heights, Ohio

[73] Assignee: Aquatech, Inc., Cleveland, Ohio

[21] Appl. No.: 876,900

[22] Filed: Feb. 13, 1978

[51] Int. Cl.[2] ..... B08B 3/02; B08B 9/04

[52] U.S. Cl. ..... 15/302; 15/315; 15/340; 15/352; 15/353; 134/168 C

[58] Field of Search ..... 15/302, 304, 315, 320, 15/321, 340, 352, 353; 134/167 C, 168 C; 239/198, 199

[56] References Cited

U.S. PATENT DOCUMENTS

| | | | |
|---|---|---|---|
| 2,643,732 | 6/1953 | Keen | 55/216 |
| 3,007,186 | 11/1961 | Olsson | 15/104.3 SN |
| 3,011,206 | 12/1961 | Breither | 15/340 X |
| 3,267,509 | 8/1966 | Boyd | 15/340 X |
| 3,613,915 | 10/1971 | Vita | 15/340 X |
| 3,658,589 | 4/1972 | Shaddock | 134/168 C X |
| 3,910,497 | 10/1975 | Manor | 239/199 X |
| 4,134,174 | 1/1979 | Flynn et al. | 15/302 |

*Primary Examiner*—Christopher K. Moore
*Attorney, Agent, or Firm*—Pearne, Gordon, Sessions

[57] ABSTRACT

A sewer cleaning unit is disclosed which comprises a single tank assembly mounted on a wheeled vehicle. The single tank assembly has a substantially horizontal fixed divider forming a first tank portion adapted to carry and discharge a supply of water, and a second tank portion adapted to receive and hold debris, thus obviating the disadvantages of tank designs of the prior art. The unit may also be provided with hand-operated control means near the intake end of the conduit connected to the second tank portion and a control means connected to the reel for the hose from which water is discharged from the first tank portion, the reel control means and the hand-operated control means capable of being operated simultaneously by a single operator.

29 Claims, 12 Drawing Figures

APPARATUS FOR SEWER CLEANING AND THE LIKE

BACKGROUND OF THE INVENTION

1. Field of the Invention

This invention relates to apparatus for cleaning sewer lines, pipe lines, and closed chambers and/or conduits in which water is jetted into the conduits at high pressures and in which a partial vacuum is applied for removal of liquids and solids from the conduits.

2. Description of the Prior Art

It is well-known to provide a mobile sewer cleaning unit having a reservoir for a large supply of water, and water-handling components including a hose reel, a hose normally coiled thereon, and a high pressure pump suitably connected between the reservoir and the hose to deliver water to the hose at high pressure. A nozzle which is typically attached to the free end of the hose reverses the direction of the high-pressure water in such a way as to develop a reaction force which pulls the hose into the sewer line from the hose reel. It is also conventional practice to provide a drive means for the pump including an internal combustion engine, the water handling components and drive means usually being mounted upon a rear platform of a truck or on the bed of a trailer.

It is also well-known to provide such sewer cleaning units with means for collecting the debris flushed from the sewer line by the high-pressure water system. Such debris collecting means typically include a receptacle for storing debris, a boom-mounted conduit extending from the receptacle, an intake tube at the end of the conduit to be lowered into the sewer or other chamber from which the debris is removed, and means for creating a suction force at the intake tube to suck the debris through the conduit and into the receptacle.

The suction creating means used in sewer cleaning units are generally either air conveyance systems or vacuum systems. Air conveyance systems for pickking up debris from sewer pipes and similar chambers are well-known, such as that shown in U.S. Pat. No. 3,568,589, issued to R. E. Shaddock. Such units use a large fan or compressor to create an air flow in the conduit which carries debris to a receiving tank. In contrast to these air conveyance systems, vacuum systems utilize a vacuum pump to create a partial vacuum in a collecting tank. With this vacuum, solid and liquid material in the sewer pipe or chamber is sucked through the conduit into the tank.

In general, sewer cleaning units using vacuum systems have advantages over those using air conveyance systems. Air conveyance units use an open exhaust system for their fan or compressor. When the debris tank is over-filled, contaminated water is picked up into the air stream and discharged into the atmosphere, polluting the air and damaging any objects which are sprayed. In contrast, vacuum units use a completely sealed system. When the tank becomes completely full, an automatic check valve system may be used to shut off the vacuum pump to prevent discharge of the contaminanted material.

Furthermore, vacuum units by reason of the high suction created in the tank are capable of collecting both liquid and solid material. The air movement created by an air conveyance system is capable of drawing with it solid particulate debris, but it is limited in drawing up large amounts of liquid. If water in the sewer covers the intake tube on an air conveyance unit, it will cut down the suction capability of the unit. On the other hand, vacuum systems are especially adapted to pick up liquids, since the end of the intake should be sealed in order to maintain a vacuum in the system, and this seal is usually accomplished by submerging the end of the intake tube below the water line in the sewer chamber.

In prior sewer cleaning units, the water storage reservoir tank and the debris receiving tank were either constructed in two separate tanks or in a single tank having a vertical separation. The construction of two separate tanks is costly, and the use of a single vertically divided tank creates numerous problems. The vertically separated tanks permit connection of the suction conduit only at the rear of the tank. If the debris were to be stored in the front of the tank, it would be necessary to reposition the vertical divider so that the debris could be dumped out through the rear compartment. This design is unacceptable because all of the water in the rear of the tank is then lost or dumped out with the debris.

The connection of the conduit at the rear of the tank presents various problems such as axle overloads on the vehicle. When the conduit and its supporting boom is mounted at the rear of the vehicle, there are increased loads on the rear of the vehicle, requiring an increased number of rear axles. The connection of the conduit at the rear of the vehicle also requires the operator to stand at rear of vehicle while operating the unit, thus exposing the operator to the hazards of oncoming traffic when operating the unit on busy city streets. While it would be desirable for the operator to stand in front of the vehicle and to be protected by the vehicle while operating the unit, this would require extending the rear-mounted conduit to the front of the vehicle, resulting in an extremely long conduit which would decrease the vacuum and suction capability at the intake end of the conduit.

SUMMARY OF THE INVENTION

The shortcomings and disadvantages of the prior art are overcome by the sewer cleaning apparatus of the present invention.

It is an object of the present invention to provide an improved apparatus for cleaning sewer lines, pipes and other conduits and chambers in which a high pressure water system is used to flush the chamber and a vacuum system is used to remove liquids and solids flushed from the chamber by the high pressure water system.

Another object of this invention is to provide a sewer cleaning apparatus having a single tank assembly mounted on a wheeled vehicle, which single tank assembly is substantially horizontally divided into two tank portions, one tank portion adapted to store a supply of water for the high-pressure water system and the other tank portion adapted to receive and hold debris, removed by the vacuum system.

Another object is to provide a sewer cleaning apparatus in which the conduit for carrying debris to the tank assembly may be mounted on the front of the tank assembly, thereby decreasing the load on the rear axle of the vehicle and allowing the operator to stand at the front of the vehicle while operating the apparatus, thus protecting the operator from oncoming traffic without using an excessively long conduit which may result in loss of vacuum pressure.

Another object is to provide a sewer cleaning apparatus in which the solid debris stored in one of the tank portions may be discharged from the tank portion through the conduit, thus eliminating the necessity of moving the apparatus to a dump site, while water may be returned from the debris holding tank portion to the water storage tank portion, thus increasing the effective tank capacity of the apparatus.

Another object is to provide an apparatus having a suction system and a water jetting hose reel assembly capable of being operated simultaneously by a single operator, in which hand-operated controls are positioned on the intake end of the conduit, and foot-operated controls may be connected to the hose reel, so that the operator need not remove his hands from the conduit to operate the hose reel.

Another object is to provide an apparatus also capable of being used as a sludge application for sewage treatment plants by spreading sludge pumped from the debris holding tank portion, thus permitting the transfer of sludge to lagoons or drying beds.

Another object is to provide an apparatus also capable of being used as a street flusher by pumping water from the water storage tank portion through nozzles beneath the apparatus.

These and other objects are accomplished by the apparatus of the present invention which comprises a sewer cleaning unit having a single tank assembly mounted on a wheeled vehicle. The tank assembly has a substantially horizontal fixed divider forming first and second tank portions. The first tank portion is adapted to carry a supply of water, and the second tank portion is adapted to receive and hold debris. The tank assembly has a rear door adapted to be opened to discharge debris from the second tank portion. A conduit which is adapted to be lowered into the chamber to be cleaned, is mounted on top of the tank assembly and connected to the second tank portion. Means are provided for creating a suction in the second tank portion, such as a pump, to suck debris through the conduit and into the second tank portion. A hose reel is mounted on the vehicle, the reel having a hose connected to the first tank portion. The hose is adapted to be inserted into the chamber to discharge water.

In accordance with another aspect of this invention the forward end of the conduit has a hand-operated control means adapted to be handled by an operator. Preferably, foot-operated control means are connected to the hose reel, so that the foot-operated control means and the hand-operated control means are capable of being operated simultaneously by a single operator.

DETAILED DESCRIPTION OF THE PREFERRED EMBODIMENT

Figure 1:
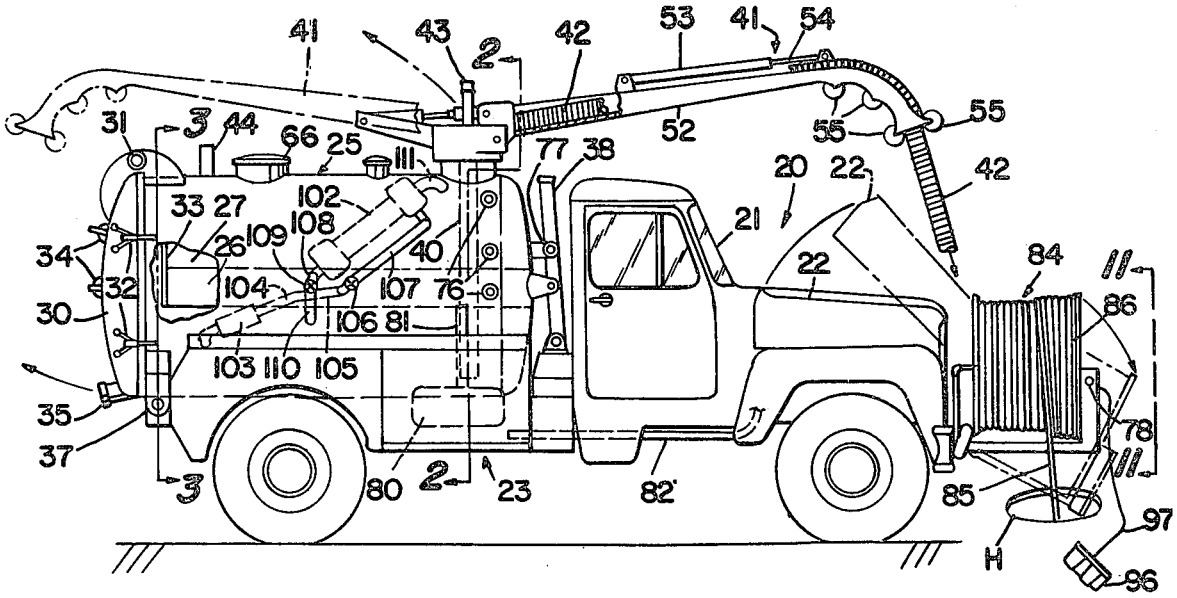
FIG. 1 is a side elevational view of the sewer cleaning unit of the present invention mounted on a truck body.
Figure 2:
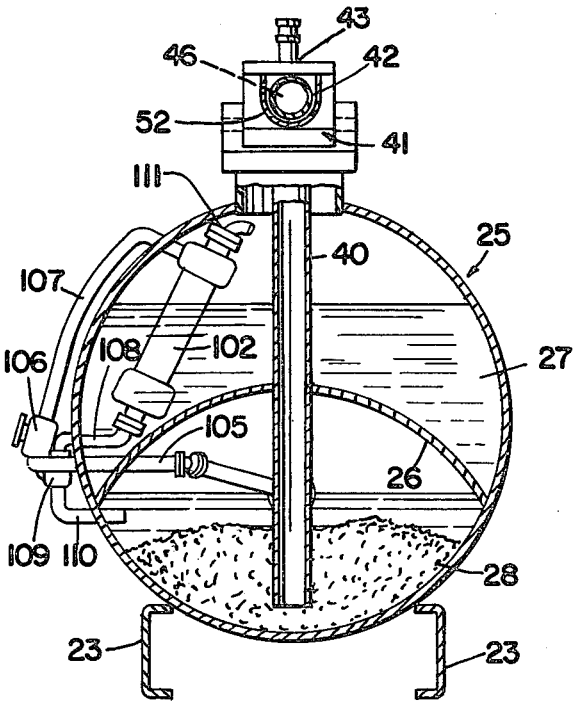
FIG. 2 is a sectional view taken along line 2—2 of FIG. 1.
Figure 3:
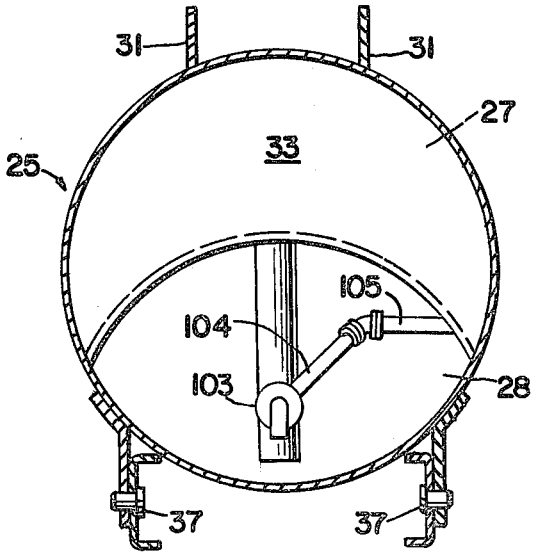
FIG. 3 is an end elevational view taken along line 3—3 of FIG. 1.

Referring more particularly to the drawings and initially to FIGS. 1-5, there is shown the sewer cleaning unit of the present invention. The unit includes a wheeled vehicle, such as a truck 20, or a trailer, railroad car, or the like. The truck 20 (FIG. 1) is of conventional design with a forward driver's cab 21 having a hood 22 containing the engine and a chassis 23 extending rearwardly from the cab. The truck engine powers a hydraulic pump which supplies hydraulic fluid to drive the other components of the unit. A generally cylindrical tank assembly 25 is mounted on the truck chassis 23 over the rear wheels of the truck. The tank assembly 25 has a curved divider 26 (FIG. 2) extending substantially horizontally along the length of the tank assembly and separating the tank assembly 25 into two permanently separated tank portions. An upper tank portion 27 forms a reservoir for the storage of water for jetting into the sewer or other chamber to be cleaned, and a lower tank portion 28 provides a receptacle for the storage of sludge, solid, and liquid debris removed from the sewer or other chamber in the cleaning operation. While the divider 26 is preferably fixed permanently in the tank assembly 25, the divider can be movable, if desired.

For the removal of debris from the lower tank portion 28, a rear door 30 (FIGS. 1, 4, 5) is pivotally mounted on a hinge 31 to the top of the rearward end of the tank assembly 25. The rear door 30 is opened and closed manually or hydraulically and is sealingly clamped to the tank assembly 25 in its closed position by latches 32 so that a vacuum may be maintained in the lower tank portion 28. The rearward end of the upper tank portion 27 is closed by a fixed rear wall 33 (FIGS. 1, 3) so that the upper tank portion 27 is not exposed when the rear door 30 is opened, but only the debris-containing lower tank portion 28 is accessible. The rear door 30 includes sight glasses 34 for indicating the level of material in the tank portions and a drain valve 35.

The entire tank assembly 25 is pivotally mounted on the rearward end of the truck chassis 23 by a hinge means 37 so that the entire tank assembly may be raised to a dumping position (FIG. 5) by a conventional hydraulic hoisting jack 38. When the tank assembly 25 is raised to its dumping position, the rear door 30 may be hydraulically opened to permit debris to be dumped from the lower tank portion 28. Water in the upper tank portion 27 is retained by the horizontal divider 26 and the rear wall 33.

Figure 4:
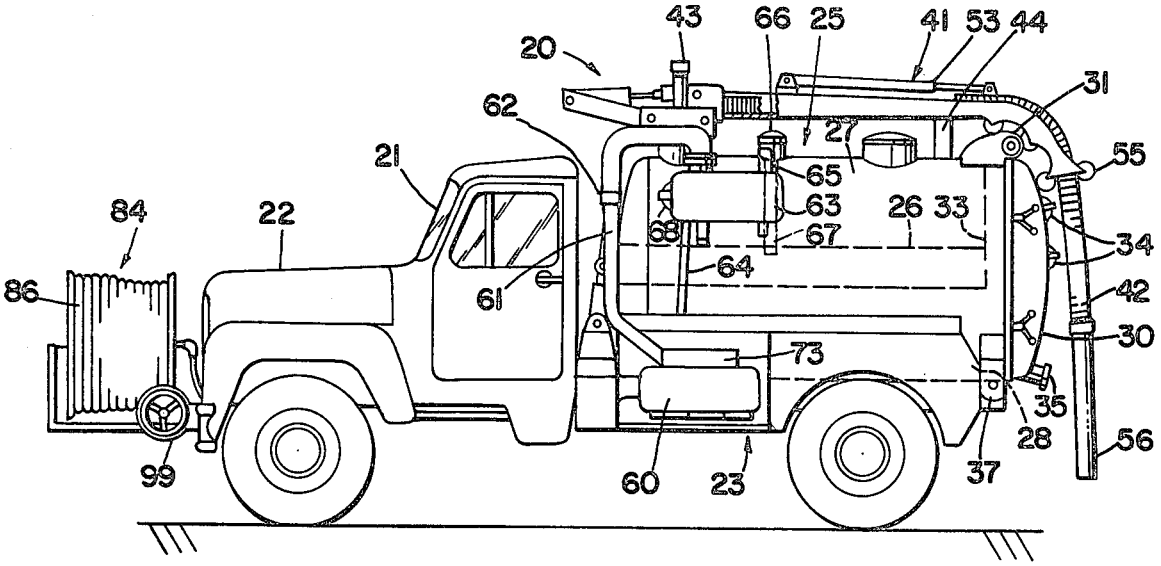
FIG. 4 is a side elevational view similar to FIG. 1 showing the opposite side of the truck-mounted unit of the present invention.

Debris enters the lower tank portion 28 through a sealed vertical tube 40 (FIGS. 1, 2) which connects the lower tank portion with an outwardly projecting boom 41 carrying a flexible conduit 42. The boom 41 extends from a mast 43 which is pivotally mounted on the top of the tank assembly 25. Hydraulically powered control means are provided to raise and lower the outwardly projecting end of the boom 41 and to rotate the boom through 300°. Due to the horizontal division of the tank assembly 25, the boom mast 43 may be mounted anywhere along the entire axis of the tank assembly. Preferably, the boom mast 43 is mounted near the forward end of the tank assembly 25. The forward mounting position permits an even distribution of weight across the vehicle and permits the boom 41 to easily extend in almost any direction for operation on all sides of the vehicle including in front of the cab 21 without requiring an excessively long conduit 42. Whenn not in use, the boom 41 extends rearwardly over the tank assembly 25 and is lowered to its bottommost position and fastened to a bracket 44 mounted on top of the tank assembly (FIG. 4). By mounting boom 41 rearwardly when not in use, the operator driving the vehicle is given an unobstructed view in the cab 21.

Figure 6:
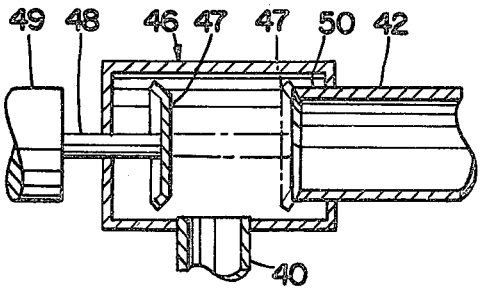
FIG. 6 is a detailed view of the valve mechanism at the connection of the conduit on top of the tank assembly.

A hydraulically or pneumatically operated valve 46 (FIG. 6) is provided between the top of the vertical tube 40 and the end of the conduit 42. The valve 46 includes a valve head 47 operable on a piston rod 48 extending from a cylinder 49, the head 47 being capable of resting on a valve seat 50 at the end of the conduit 42. Upon actuation of the valve 46, the conduit 42 is closed from the lower tank portion 28.

The construction of boom 41 includes a telescopic support 52 (FIG. 1) which may be extended by a hydraulic cylinder 53 having a piston rod 54. The flexible conduit 42 is maintained within the support 52. At the projecting end of the boom 41, the support 52 curves downwardly, and the flexible conduit 42 is support on a plurality of rollers 55. An intake tube 56 (FIGS 4, 10), for insertion downwardly into the sewer or other chamber to be cleaned, is connected to the end of the flexible conduit 42. A pair of operator-controlled handles 57 (FIG. 10) are mounted on each side of the intake tube 56 to assist the operator in guiding the tube 56 into the manhole H or chamber entrance. Push button controls 58, which are included on the handles 57, are connected to the unit by cables and include controls for the operation of the boom 41 and of the apparatus which produces a vacuum in the lower tank portion 28 to produce suction in the conduit 42. Separate boom controls are also located at the rear of the tank assembly 25.

Figure 5:
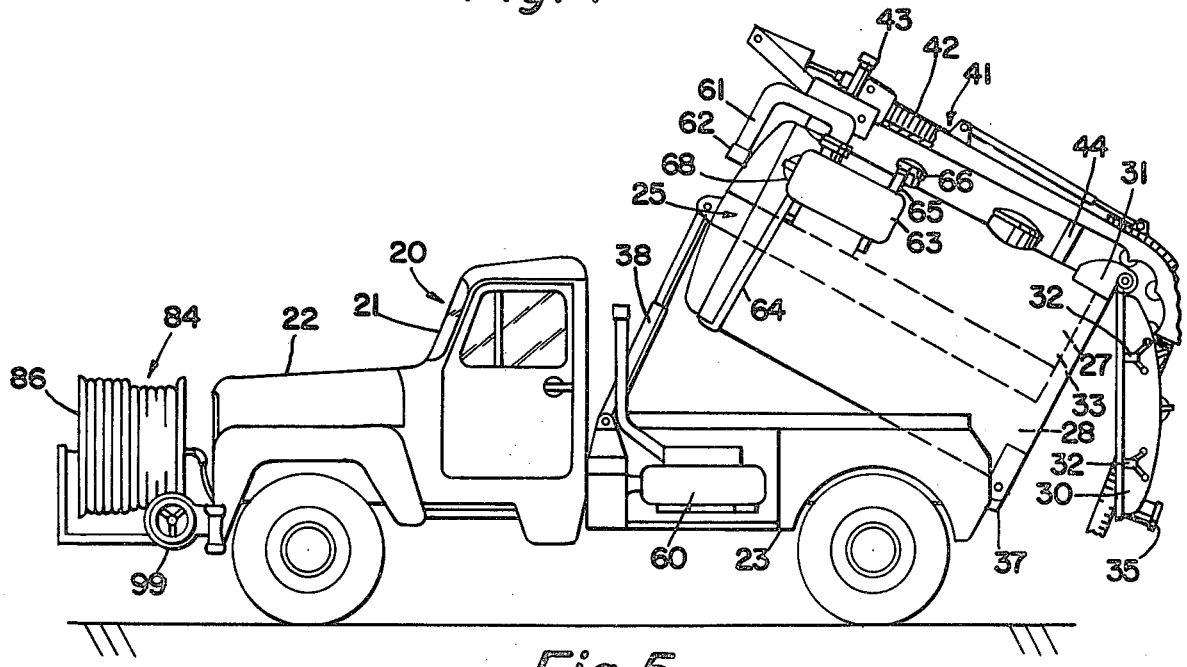
FIG. 5 is a side elevational view similar to FIG. 4 showing the unit with the tank assembly raised for the discharge of debris from the tank assembly.

A vacuum is produced in the lower tank assembly 28 by means of a rotary-vane vacuum pressure pump 60 mounted on one side of the truck chassis 23 beneath the tank assembly 25 (FIG. 4). The pump 60 is connected by a hose 61 which extends along the front of the tank assembly 25 and which includes a quick-disconnect fitting 62 which separates when the tank assembly 25 is lifted to its dumping position (FIG. 5). The other end of the hose 61 is connected to a moisture trap 63 which removes moisture in the air from the lower tank assembly 28 to protect the pump 60 by preventing contaminantion from entering the pump. A drain hose 64 extends from the moisture trap 63 down along the side of the tank assembly 25 for the release of moisture removed by the trap. The other end of the moisture trap 63 is connected by a hose 65 to a port 66 on the top of the tank assembly 25 which is connected to the lower tank portion 28 by a vertical tube 67. If desired, the moisture trap 63 may be provided with a conventional sight glass 68.

Figure 7:
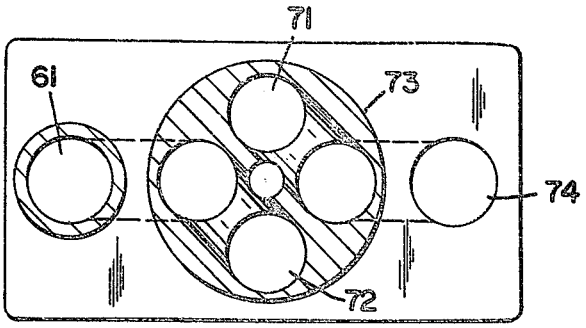
FIG. 7 is a top sectional view of the reverse valving mechanism of the vacuum pump taken along line 7—7 of FIG. 9.
Figure 8:
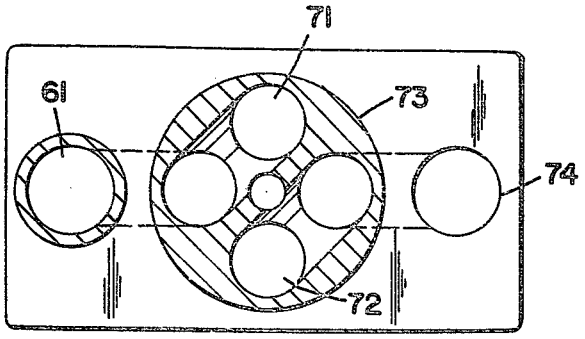
FIG. 8 is a top sectional view similar to FIG. 7 showing the mechanism in its reversed position.
Figure 9:
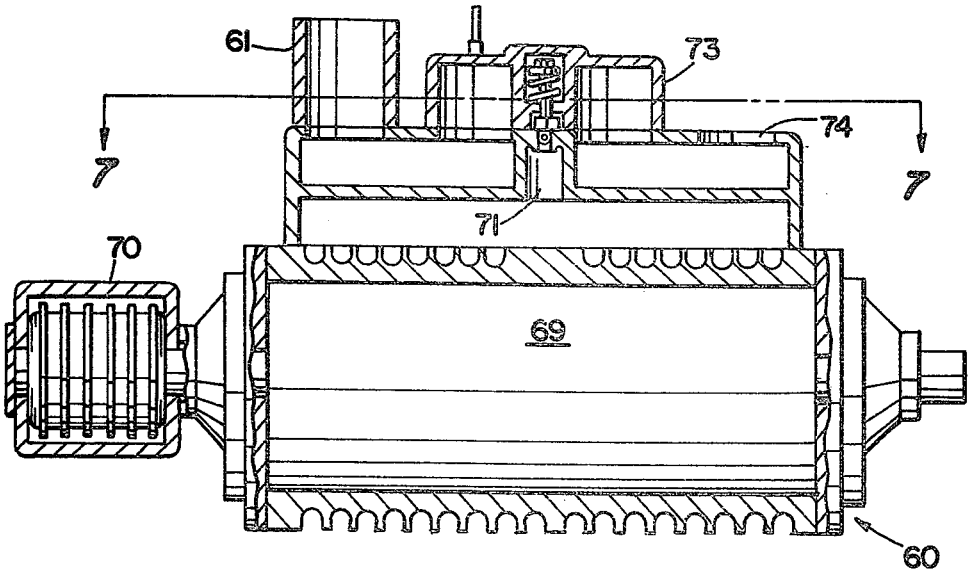
FIG. 9 is a side elevational view in section of the vacuum pump of the unit showing the reverse valving mechanism.

Vacuum pump 60 is shown in greater detail in FIGS. 7–9. The pump 60 includes a known rotary pumping assembly 69 powered by a hydraulic drive unit 70 or by any conventional mechanical drive, such as a belt drive. An inlet port 71 and an outlet port 72 are connected to a reverse valving mechanism 73 which is rotatably mounted on the top of the pump 60. The mechanism connects the ports 71 and 72 with the hose 61 which leads to the lower tank portion 28 and with an exhaust port 74. Under normal operation as shown in FIG. 8, the mechanism 73 is positioned such that the hose 61 is connected to the inlet port 71 and the outlet port 72 is connected to the exhaust port 74, and the pump 60 operates to pump out air from the lower tank assembly 28, and thus produce a vacuum in the lower tank portion to permit debris to be sucked thereinto. Upon rotation of the mechanism 73 (FIG. 7), the hose 61 is connected to the outlet port 72 while the inlet port 71 is connected to the exhaust port 74, and the action of the pump 60 is reversed so that a positive pressure is applied to the lower tank portion 28. With the positive pressure established in the lower tank portion 28 by the pump 60, it is possible to force liquid debris from the lower tank portion up through the vertical tube 40. By using compression from the vacuum pump 60, liquids in the lower tank portion 28 may be discharged back through the intake tube 56 to remove liquids from the lower tank portion without moving the unit. This liquid discharging capability increases the usable capacity of the tanks by allowing the tanks to be filled primarly with solid debris and sludge.

Figure 12:
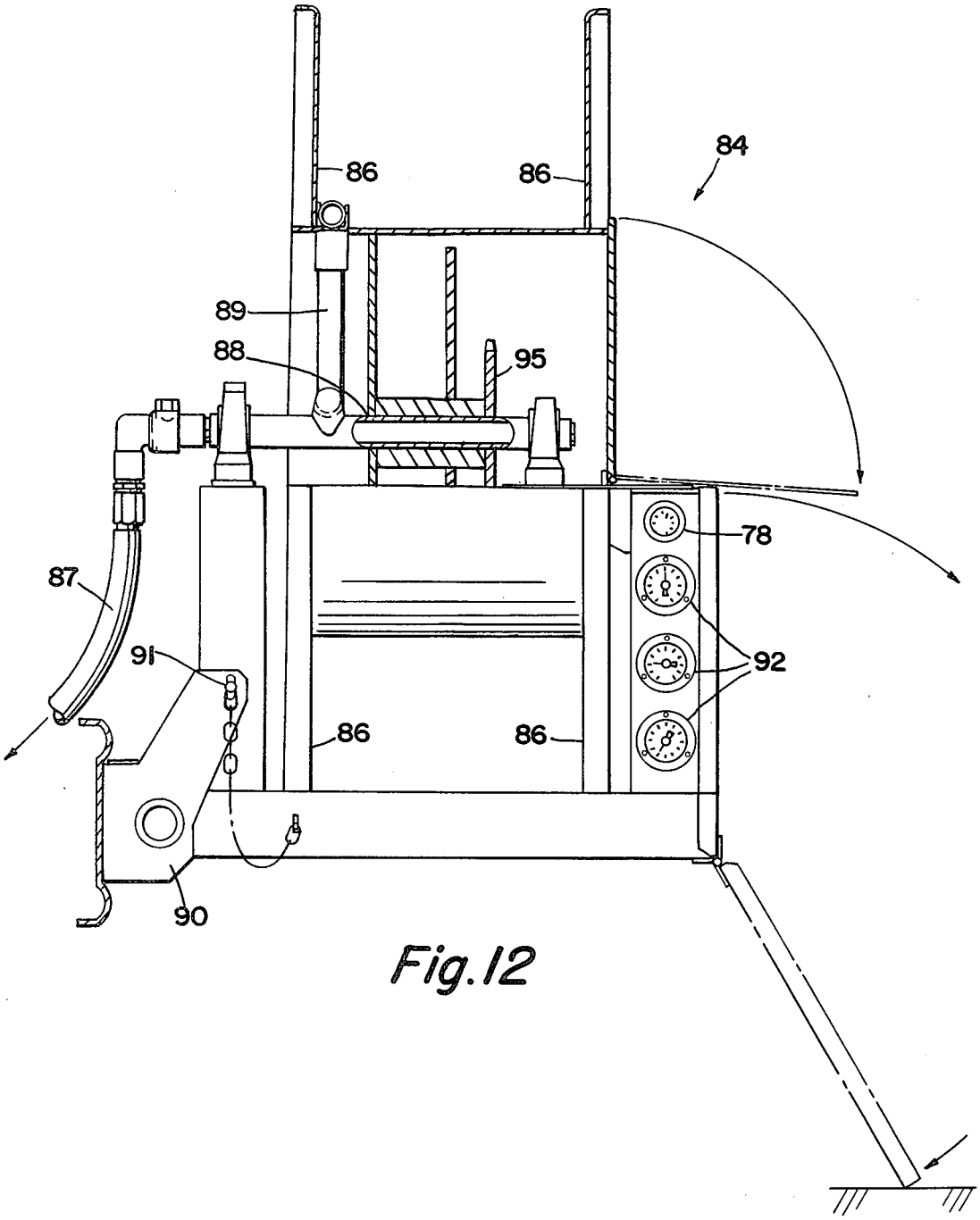
FIG. 12 is a side elevational detailed view of the hose reel partially sectioned taken along line 12—12 of FIG. 11.

To provide a visual indication that the lower tank portion 28 is filled with debris or that the upper tank portion 27 has reached a certain level, conventional sight glasses 76 and 77 (FIG. 1) are connected to the tank portions 27 and 28, respectively. The sight glasses 76 are connected at various levels to the upper tank portion 27 and are vertically spaced on the exterior side of the tank assembly 25, while the slight glass 77 is connected to the top of the lower tank portion 28 and extends laterally from the front of the tank assembly 25 so that it can be seen from the front of the unit. The drive unit 70 of the vacuum pump 60 includes an automatic check valve shutoff mechanism which stops the pump when the lower tank portion 28 is full or when the upper tank portion 27 is empty. A warning light 78, which may be mounted on the front hose reel assembly (FIGS. 1, 12), provides a visual indication to the operator that the automatic shut-off mechanism has been actuated.

Water is discharged from the upper tank portion 27 through a high-pressure jetting pump 80 (FIG. 1) which is mounted on the truck chassis 23 beneath the tank assembly 25 opposite the vacuum pump 60. The pump 80 is connected to the upper tank portion 27 by a hose 81. The exhaust from the truck engine is fed back through an exhaust pipe 82 into the compartment containing the high pressure pump 80, thus keeping the pump and the water piping system above freezing temperatures regardless of the outside ambient temperature.

A hose reel assembly 84 (FIG. 11, 12) is mounted on the front of the cab 21. The assembly 84 includes a high-pressure flexible hose 85 wound on a reel 86. The hose reel 84 may be similar to that disclosed in U.S. Pat. No. 3,476,139. The hose 85 is connected to the high-pressure jetting pump 80 by a tube 87, hollow shaft 88 and tube 89. The reel 86 is mounted for rotation on the shaft 88. In accordance with known design, the hose 85 may be provided with a self-propelling spray nozzle on its leading end which has rearwardly directed outlets, so that the force of the water issuing from the outlets propels the leading end of the hose through a sewer pipe or other conduit. If desired, a conventional rotary root cutting head may also be installed on the leading end of the hose 85. Preferably, the hose reel assembly 84 is pivotally mounted to the front of the cab 21 on a hinge 90 permitting the assembly 84 to be lowered upon the release of a locking pin 91, as desired. This pivoting of the reel assembly 84 permits the assembly to be moved out of the way when the truck hood 22 is raised (FIG. 1). Adjacent to the reel 86 are the warning light 78 and a plurality of gauges 92 for monitoring the various pressures on the unit. The reel 86 may be driven by a hydraulic motor 94 which is supplied with hydraulic fluid by the hydraulic system powered by the truck chassis motor. The motor 94 is connected to the shaft 88 by means of a sprocket and chain drive 95. The rotation of the hose reel 86 is controlled by a foot control 96 (FIGS. 1, 10) which is attached to the reel assembly 84 by a line 97 such as a cable or hose. The control 96 is preferably an electrical switch connected by a cable to control the flow direction of a hydraulic valve in the line which supplies fluid to the hydraulic motor 94, so that actuation of the switch 96 by the operator drives the hydraulic motor forward or reverse for rotation of the reel 86. Alternatively, the control 96 may be a hydraulic valve connected by a hose to the motor 94 so that actuation of the switch 96 by the operator directly starts or reverses the flow of fluid to the motor. The operator thus controls the pay-out and retrieval of the hose 85 from the hose reel 86 by means of the foot control switch 96 which may be operated simultaneously with the hand-operated controls 58 on the intake tube 56.

The electrical switch incorporated in the foot control 96 may also be located with the hand controls 58 on the handles 57 so that the operator may simultaneously control the operations of the unit by operating the controls on the handles.

A smaller hose reel 99 (FIGS. 4, 10) is also mounted on the front cab 21 and is connected to the supply of water in the upper tank portion 27. A smaller flexible hose 100 is wound on the smaller hose reel 99 and is equipped with a hand-operated spray nozzle gun. The smaller hose 100 may be used for operations such as manually cleaning residual debris from the lower tank portion 28.

If desired, the truck may also be provided with street flushing nozzles beneath the truck body, with appropriate piping connecting the flushing nozzles with the jetting pump 80, or with an additional flushing pump.

To permit water mixed with the sludge and sold debris in the lower tank portion 28 to be transferred to the upper tank 27 and be reused, the unit may be provided with a centrifugal separator 102 in the upper tank assembly 27 (FIGS. 1, 2), which may be similar to the separator shown in U.S. Pat. No. 3,947,364. Water mixed with debris which is fed to the separator 102 is collected in the lower tank portion 28 through a floating collector 103 having a float which maintains the collector at the top level of the liquid in the lower tank portion, so that the collector receives the liquid in the tank portion without being clogged with solid debris. The floating collector 103 is connected by a hollow lever arm 104 to a hose 105 which extends from the lower tank portion 28, and which leads to a valve 106. A hose 107 is connected to the other end of the valve 106 and extends along the exterior of the tank assembly 25 and is connected to the inlet end of the separator 102. The lower discharge end of the separator 102 from which solid debris is discharged is connected to the lower tank portion 28 by a fitting 108 which extends out of the upper tank portion 27, a valve 109 on the exterior of the tank assembly 25 at the end of the fitting 108, and a hose 110 which is connected to the valve 109 and extends into the lower tank portion. Water removed by the separator 102 is returned to the upper tank portion 27 through upper outlet 111.

Figure 10:
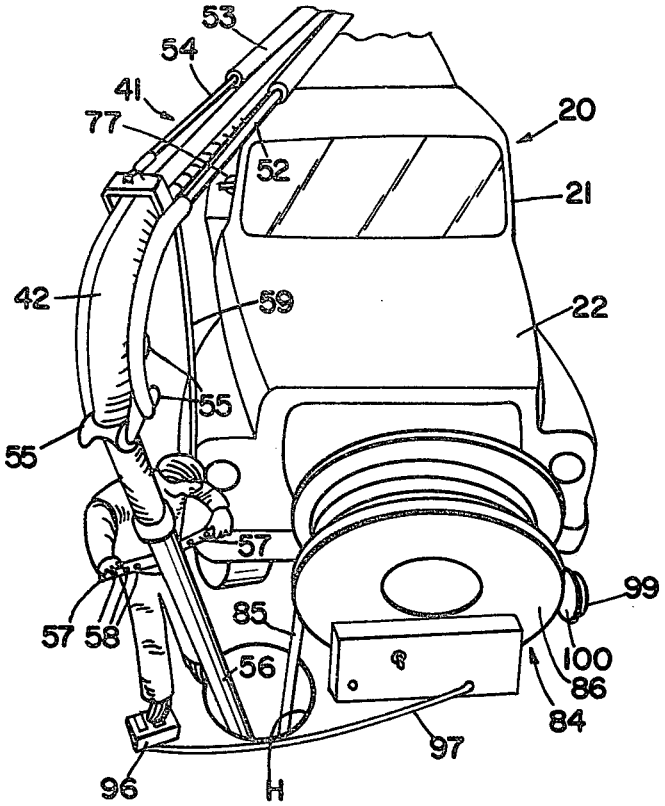
FIG. 10 is a front perspective view of the apparatus showing the simultaneously operable hand and foot controls.
Figure 11:
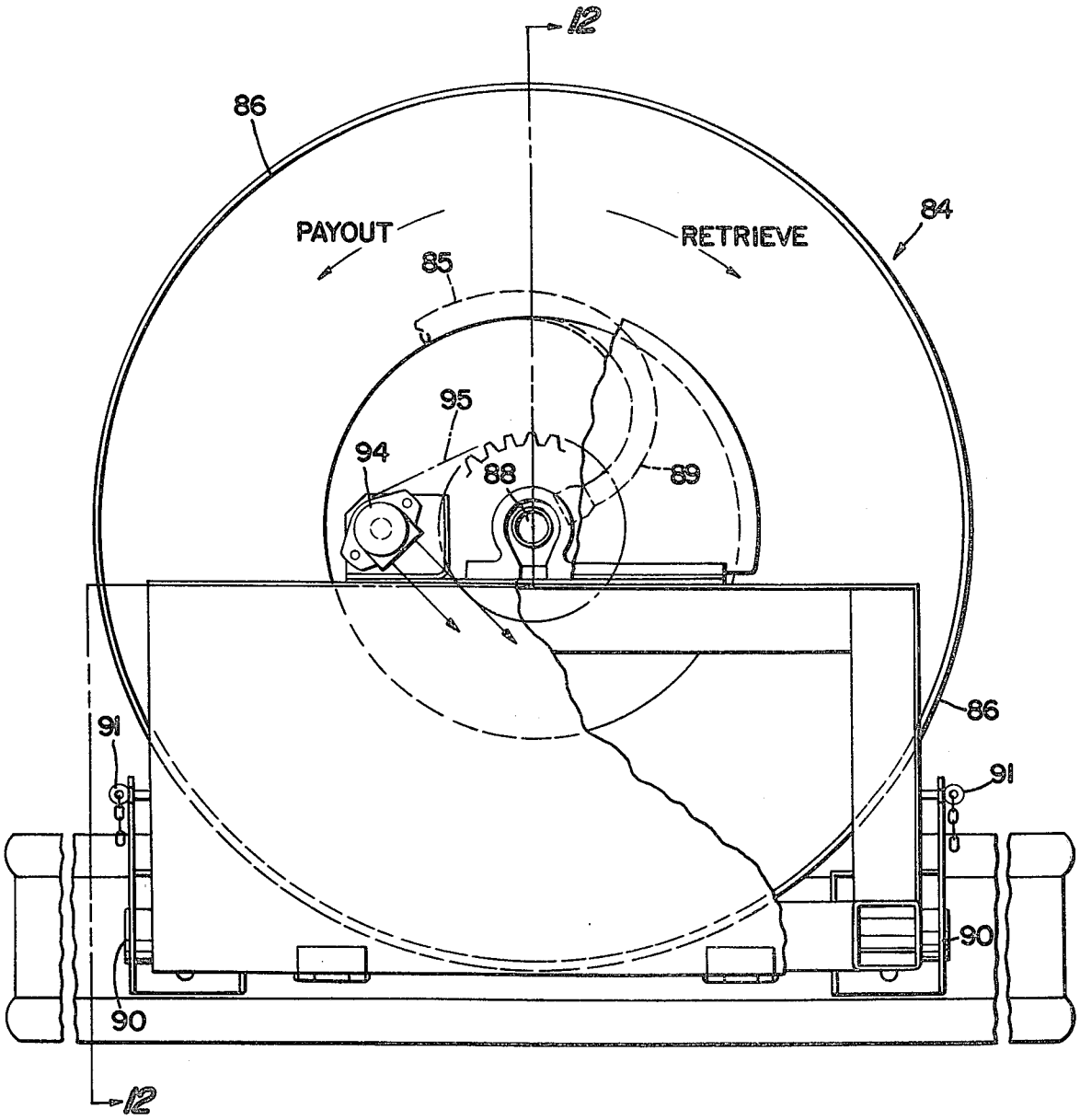
FIG. 11 is a front elevational view of the hose reel to a larger scale than FIGS. 1 and 10, and taken along line 11—11 of FIG. 1.

In the operation of the sewer cleaning unit of the present invention, the truck 20 may be driven over streets or roads and is positioned with the module H or other opening to a chamber in front of and preferably to the right of the vehicle as shown in FIGS. 1 and 10. The hydraulically powered boom controls are actuated to position the boom 41 toward the front of the vehicle so that the intake tube 56 connected to the conduit 42 can extend downwardly into the hole. The operator then positions himself adjacent to the hole (FIG. 10) and moves the foot control 96 so that it can be easily operated. The motor 94 driving hose reel 86 is actuated to unwind the jetting hose 85 from the reel downwardly into the hole. The operator then grasps the handles 57 on the intake tube 56 and using the controls 58 on the handle, extends and positions the boom 41 so that the tube extends downwardly into the hole. Using the controls 58 and 96, the operator can simultaneously control the operations of the unit.

The jetting pump 80 is actuated so that water is supplied from the upper tank portion 27 to the hose 85. The self-propelling nozzle on the leading end of the hose 85 feeds the hose through the sewer pipe or other conduit to be cleaned as the hose unwinds from the reel 86. The operator then actuates the hydraulic drive unit 70 on the vacuum pump 60 to create a partial vacuum in the lower tank portion 28. With the hydraulically controlled valve 46 open, suction is created at the mouth of the intake tube 56 so that debris is carried from the chamber through the conduit 42 and into the lower tank portion 28.

When the supply of jetting water decreases, as indicated by the sight glass 76, water can be recovered from the contents of the lower tank portion 28. With the valve 46 at the top of the vertical tube 40 closed, the valves 106 and 109 on the exterior of the tank assembly 25 are opened, and the reversible valving mechanism 73 on the vacuum pump 60 is rotated to revese the connections on the inlet and outlet ports 71 and 72 of the vacuum pump. The drive unit 70 to the pump 60 is actuated to create a positive pressure in the lower tank portion 28, forcing liquid entering the floating collector 103 up through the hose 107 and into the centrifugal separator 102. Clean water is thus forced out of the separator 102 into the upper tank portion 27 to replenish the supply of water therein, and the suspended solids in the debris are returned from the separator 102 to the lower tank portion 28 through the fitting 108 and the hose 110. After sufficient liquid has been removed from the lower tank portion 28, the valve 106 leading to the inlet of the separator 102 is closed, and the reversible valving mechanism 73 on the vacuum pump 60 is returned to its normal operating position. With the valve 109 open, suction is created in the lower tank portion 28 by the vacuum pump 60, pulling all of the remaining solid debris out of the separator 102 through the fitting 108 and hose 110. After the separator 102 is cleaned of debris, the valve 109 is closed, and the unit may be again used for other operations.

If desired, liquid contents in the lower tank portion 28 can also be removed through the conduit 42. With the valve 46 open, the reversible valving mechanism 73 on the vacuum pump 60 is positioned so that the pump 60 creates a positive pressure in the lower tank portion 28. This pressure separates the solid and liquid debris in the lower tank portion 28 and forces the liquids up the vertical tube 40 and out the conduit 42 to a convenient disposal site at the end of the intake tube 56 without moving the truck.

Since the sight glass 77 extends from the side of the tank assembly 25, the operator can easily see the sight glass 77 from his normal operating position at the side of the hose reel assembly 84, and can immediately tell when the lower tank portion 28 is full. When the lower tank portion 28 is full of sludge and solid debris, the truck 20 can be driven to a disposal site, whereupon the latches 32 are loosened, the hydraulically powered rear door 30 is opened, and the hydraulic hoisting jack 38 is actuated to raise the tank assembly 25 and dump debris from the lower tank portion 28 (FIG. 5). Water in the upper tank portion 27 is not released because of the design of the tank assembly having the substantially horizontal divider 26 and the rear wall 33 at the end of the upper tank portion 27 which prevents water from escaping from the tank portion 27 when the rear door 30 is opened.

The unit can also be used for the application of sludge to lagoons and drying beds in sewer treatment plants. Sludge may be forced out of the lower tank portion 28 by positive pressure produced by the vacuum pump 60 with the mechanism 73 in its reversed position. The sludge can then be spread by known means attached to the rear of the truck chassis 23, such as, for example, an applicator attached to the rear drain 35. An additional high volume progressive cavity pump may also be used to permit rapid transfer of sludge from the lower tank portion.

If desired, the entire tank assembly 25 can be used as a water storage, such as, for instance, when the vehicle is used as a street flusher. In this mode of operation, the lower tank portion 28 as well as the upper tank portion 27 are filled with water, and the water is pumped using the vacuum pump 60 in its reversed position and the jetting pump 80 or using the additional high volume progressive cavity pump to appropriate flushing nozzles located beneath the vehicle.

While the preferred form of this invention has been specifically illustrated and described herein, it will be apparent to those skilled in the art that modification and improvements may be made to the form herein specifically disclosed. Accordingly, the present invention is not to be limited to the form herein specifically disclosed nor in any other way inconsistent with the progress in the art promoted by this invention.

What is claimed is:

1. Apparatus for cleaning a chamber, which comprises:

a wheeled vehicle;

a single horizontally extending tank assembly mounted on said vehicle, said tank assembly having a fixed divider forming a first tank portion adapted to carry a supply of water and a second tank portion adapted to receive and hold debris, the vertical cross sections of the tank assembly being generally the same along its horizontal length so that the first and second tank portions both extend substantially from the front of the tank assembly to the rear of the tank assembly, said tank assembly having a rear door adapted to be opened to discharge debris from said second tank portion;

a conduit extending from said tank assembly and connected to said second tank portion, the end of said conduit adapted to be lowered into the chamber to be cleaned;

means for creating suction in said second tank portion to suck debris through said conduit and into said second tank portion; and a hose reel mounted on said vehicle, said reel having a hose connected to said first tank portion, said hose adapted to be inserted into the chamber to discharge water thereinto.

2. Apparatus for cleaning a chamber as in claim 1, wherein said conduit has hand-operated control means near its end adapted to be handled by an operator, and said reel has control means, said hand-operated control means and said reel control means positionable to be operated simultaneously by a single operator.

3. Apparatus for cleaning a chamber as in claim 2, wherein said reel has foot-operated control means.

4. Apparatus for cleaning a chamber as in claim 1 wherein the suction creating means includes means for discharging debris from said second tank portion through said conduit.

5. Apparatus for cleaning a chamber as in claim 1, wherein said suction creating means comprises a pump connected to said second tank portion to create a partial vacuum therein.

6. Apparatus for cleaning a chamber as in claim 5, wherein said suction creating means also includes reversible means associated with said pump for creating positive pressure in said second tank portion to propel debris from said second tank portion through said conduit.

7. Apparatus for cleaning a chamber as in claim 1, comprising in addition means for tilting said tank assembly rearwardly to dump debris from said second tank portion when said rear door is opened.

8. Apparatus for cleaning a chamber as in claim 1, comprising in addition means connected to said first and second tank portions for separating liquid from debris in said second tank portion and returning the liquid to said first tank portion.

9. Apparatus for cleaning a chamber as in claim 1, wherein said first tank portion is located above said second tank portion.

10. Apparatus for cleaning a chamber as in claim 1, wherein said conduit is pivotally mounted near the forward end of the top of said tank assembly and wherein said conduit is capable of pivoting through an angle of 300°.

11. Apparatus for cleaning a chamber as in claim 1, wherein said hose reel is mounted on the front of said vehicle.

12. Apparatus for cleaning a chamber, which comprises:

a wheeled vehicle;

a tank assembly mounted on said vehicle, said tank assembly having a first tank portion adapted to carry a supply of water and a second tank portion adapted to receive and hold debris;

a conduit extending from said tank assembly and connected to said second tank portion, the forward end of said conduit adapted to be lowered into the chamber to be cleaned, said conduit having a pair of handles near its forward end adapted to be handled by an operator for guiding the conduit into the chamber, with hand-operated control means on said handles;

means for creating suction in said second tank portion to suck debris through said conduit into said second tank portion, said suction creating means being controlled by said hand-operated control means; and a hose reel assembly mounted on said vehicle, said reel assembly having a reel with a hose connected to said first tank portion, said hose adapted to be inserted into the chamber to discharge water thereinto, said reel assembly having control means connected thereto, said reel assembly control means and said hand-operated control means on said handles positionable to be operated simultaneously by a single operator.

13. Apparatus for cleaning a chamber as in claim 12 wherein said reel assembly has foot-operated control means for controlling pay-out and retrieval of the hose.

14. Apparatus for cleaning a chamber as in claim 13 wherein said foot-operated control means comprises a fluid valve controlling fluid flow to a fluid operated motor in said reel assembly which rotates said reel.

15. Apparatus for cleaning a chamber as in claim 13 wherein said foot-operated control means comprises an electrical switch controlling current flow to an electrically actuated motor in said reel assembly which rotates said reel.

16. Apparatus for cleaning a chamber as in claim 12 wherein said suction creating means includes means for discharging debris from said second tank portion through said conduit.

17. Apparatus for cleaning a chamber as in claim 12, wherein said suction creating means comprises a pump connected to said tank portion to create a partial vacuum therein.

18. Apparatus for cleaning a chamber as in claim 17, wherein said suction creating means also includes reversible means associated with said pump for creating positive pressure in said second tank portion to propel debris from said second tank portion through said conduit.

19. Apparatus for cleaning a chamber as in claim 12, comprising in addition a rear door on said tank assembly adapted to be opened, and means for tilting said tank assembly rearwardly to dump debris from said second tank portion when said rear door is opened.

20. Apparatus for cleaning a chamber as in claim 12, comprising in addition means connected to said first and second tank portions for separating liquid from debris in said second tank portion and returning the liquid to said first tank portion.

21. Apparatus for cleaning a chamber as in claim 12, wherein said conduit is pivotally mounted near the forward end of the top of said tank assembly and wherein said conduit is capable of pivoting through an angle of 300°.

22. Apparatus for cleaning a chamber as in claim 12, wherein said hose reel assembly is mounted on the front of said vehicle.

23. Apparatus for cleaning a chamber, which comprises:

a wheeled vehicle;

a single tank assembly mounted on said vehicle, said tank assembly having a first tank portion adapted to carry a supply of water and a second tank portion adapted to receive and hold debris;

a conduit extending from said tank assembly near the forward end thereof and connected to said second tank portion, the forward end of said conduit adapted to be lowered into the chamber to be cleaned;

means for sucking debris through said conduit and into said second tank portion by creating suction in said second tank portion, and for discharging debris from said second tank portion through said conduit, said sucking and discharging means being connected to said second tank portion by a single tube; and a hose reel mounted on the front of said vehicle, said reel having a hose connected to said first tank portion, said hose adapted to be inserted into the chamber to discharge water thereinto.

24. Apparatus for cleaning a chamber as in claim 23, wherein said sucking and discharging means comprises a pump connected to said second tank portion by said single tube to create a partial vacuum therein.

25. Apparatus for cleaning a chamber as in claim 24, wherein said sucking and discharging means also comprises a reversible mechanism connected to the ports of said pump to permit said pump to force air into said second tank portion to create positive pressure in said second tank portion instead of withdrawing air to create a suction therein.

26. Apparatus for cleaning a chamber as in claim 23 comprising in addition a rear door on said tank assembly adapted to be opened, and means for tilting said tank assembly rearwardly to dump debris from said second tank portion when said rear door is opened.

27. Apparatus for cleaning a chamber as in claim 23 comprising in addition means connected to said first and second tank portions for separating liquid from debris in said second tank portion and returning the liquid to said first tank portion.

28. Apparatus for cleaning a chamber as in claim 23 wherein said conduit is pivotally mounted near the forward end of the top of said tank assembly and wherein said conduit is capable of pivoting through an angle of 300°.

29. Apparatus for cleaning a chamber, which comprises:

a truck having a forward cab and a rear body;

a single horizontally extending tank assembly mounted on the body of said truck, said tank assembly having a fixed divider forming an upper tank portion adapted to carry a supply of water and a lower tank portion adapted to receive and hold debris, the vertical cross sections of the tank assembly being generally the same along its horizontal length so that the first and second tank portion both extend substantially from the front of the tank assembly to the rear of the tank assembly, said tank assembly having a rear door adapted to be opened to discharge debris from said lower tank portion, said tank assembly also having means connected thereto for tilting said tank assembly rearwardly to dump debris from said lower tank portion when said rear door is opened;

a conduit pivotally mounted near the forward end on top of said tank assembly and connected to said lower tank portion, the forward end of said conduit adapted to be lowered into a chamber to be cleaned, said conduit having valve means for closing said conduit, said conduit having a pair of handles near its forward end adapted to be handled by an operator for guiding the conduit into the chamber, with hand-operated control means on said handles;

reversible pump means for creating a partial vacuum in said lower tank portion to suck debris through said conduit into said lower tank portion and for creating positive pressure in said lower tank portion to propel debris from said lower tank portion through said conduit when said valve means in said conduit is open, said pump means being controlled by said hand-operated control means;

separator means connected to said upper and lower tank portions for separating liquid from debris forced from said lower tank portion by said reversible pump means when said valve means in said conduit is closed and for returning the liquid to said upper tank portion; and a hose reel assembly mounted in front of the cab on said truck, said reel assembly having a reel with a hose connected to said upper tank portion, said hose adapted to be inserted into the chamber to discharge water thereinto, said reel assembly having foot-operated control means, said foot-operated control means and said hand-operated control means on said handles positionable to be operated simultaneously by a single operator.

* * * * *